US005494560A

United States Patent [19]

Arimoto et al.

[11] Patent Number: 5,494,560

[45] Date of Patent: Feb. 27, 1996

[54] LOW-HYDROGEN OVERVOLTAGE CATHODE HAVING ACTIVATED CARBON PARTICLES SUPPORTING PLATINUM, RHODIUM, INDIUM, OR PLATINUM IN A NICKEL LAYER FORMED ON A SUBSTRATE

[75] Inventors: Osamu Arimoto; Shinji Katayama, both of Okayama, Japan

[73] Assignee: Chlorine Engineers Corp., Ltd., Tokyo, Japan

[21] Appl. No.: 309,762

[22] Filed: Sep. 21, 1994

[30] Foreign Application Priority Data

Sep. 22, 1993 [JP] Japan ..... 5-236976

[51] Int. Cl.[6] ..... C25B 11/06

[52] U.S. Cl. ..... 204/290 R

[58] Field of Search ..... 204/290 R, 204 F; C25B 11/04, 11/06, 11/08, 11/10

[56] References Cited

U.S. PATENT DOCUMENTS 4,496,442 1/1985 Okazaki et al. ..... 204/129

FOREIGN PATENT DOCUMENTS 3132269 5/1982 Germany ..... 204/290 R 0035689 2/1982 Japan ..... 204/290 R

*Primary Examiner*—Kathryn Gorgos

*Attorney, Agent, or Firm*—Kuhn and Muller

[57] ABSTRACT

Electroplating is carried out in a nickel plating bath in which are dispersed active carbon particles supporting at least one platinum metal selected from the group consisting of platinum, rhodium, iridium, and palladium, thereby forming on an electrode substrate a nickel electrode active layer containing platinum metal-supporting active carbon particles and having such active carbon particles attached to a surface layer thereof, and thus producing a cathode exhibiting a high electrode activity and capable of stably sustaining a low hydrogen overvoltage for a long period of time.

1 Claim, 1 Drawing Sheet

LOW-HYDROGEN OVERVOLTAGE CATHODE HAVING ACTIVATED CARBON PARTICLES SUPPORTING PLATINUM, RHODIUM, INDIUM, OR PLATINUM IN A NICKEL LAYER FORMED ON A SUBSTRATE

BACKGROUND OF THE INVENTION

The present invention relates to a cathode capable of electrolyzing aqueous alkali metal halide and alkali metal hydroxide solutions at a low hydrogen overvoltage for a long period of time, and also pertains to a method of producing the low-hydrogen overvoltage cathode.

When an aqueous alkali metallic halide solution or an aqueous alkali metal hydroxide solution is electrolyzed by the diaphragm process, the ion-exchange membrane process, or the like, hydrogen is evolved at the cathode. Hitherto, the cathode has been formed using a material composed mainly of soft steel or stainless steel. However, the cathode made of soft steel or stainless steel has the drawback that the hydrogen overvoltage is high. For this reason, various types of low-hydrogen overvoltage cathodes have been proposed.

The low-hydrogen overvoltage cathode is demanded to be capable of stably sustaining a low hydrogen overvoltage for a long period of time, to cause no elution of impurities in the catholyte at the time of starting an electrolytic cell operation or during the cell operation, not to ignite or deteriorate its performance characteristics on contact with the air during dismantling of the electrolytic cell or under other circumstances, and to be less costly.

A cathode coated with Raney nickel or Raney nickel and a hydrogen-occluding alloy by composite plating, as disclosed in Japanese Patent Application Post-Examination Publication No. 61-12032 (1986) or 61-36590 (1986), has an advantage in that the hydrogen overvoltage is low. However, the disclosed cathode suffers from the problem that it may ignite or deteriorate its performance characteristics on contact with the air during dismantling of the electrolytic cell or under other circumstances. Japanese Patent Application Post-Examination Publication No. 63-4920 (1988) and Japanese Patent Application Laid-Open (KOKAI) No. 62-253791 (1987) disclose cathodes which are electroplated with a nickel-tin alloy, and Japanese Patent Application Laid-Open (KOKAI) No. 62-284094 (1987) discloses a cathode which is electroplated with a nickel-chromium alloy. These cathodes suffer, however, from the problems that the hydrogen overvoltage is higher than that of the cathode that is composite-plated with Raney nickel or Raney nickel and a hydrogen-occluding alloy, and that tin and chromium ions are eluted in the catholyte at the time of starting an electrolytic cell operation or during the cell operation, and further that the cathode deteriorates its performance characteristics on contact with the air.

Japanese Patent Application Post-Examination Publication Nos. 25-2305 (1950) and 02-60759 (1990), Japanese Patent Application Laid-Open (KOKAI) No. 62-93389 (1987), etc. disclose cathodes which are formed with a nickel layer containing sulfur by carrying out electroplating in a nickel plating bath containing a sulfur compound. Japanese Patent Application Laid-Open (KOKAI) No. 57-35689 (1982) discloses a cathode formed with a nickel layer by carrying out electroplating in a nickel plating bath containing a sulfur compound and having active carbon particles dispersed therein. These cathodes have an advantage in that the performance characteristics are not deteriorated even when the cathodes come in contact with the air, but they suffer from the problems that the hydrogen overvoltage is higher than that of the active cathode which is composite-plated with Raney nickel or Raney nickel and a hydrogen-occluding alloy, and that sulfur ions are eluted in the catholyte at the time of starting an electrolytic cell operation or during the cell operation.

Japanese Patent Application Laid-Open (KOKAI) No. 57-89491 (1982) discloses a method wherein an electrode active layer is formed by carrying out nickel plating in a nickel plating bath containing platinum metal ions and having active carbon particles dispersed therein. With this method, however, since the platinum metal coprecipitates with nickel, the surface area of the platinum metal, which comes in contact with the catholyte, cannot be increased. Therefore, it is impossible to make full use of the characteristics of the platinum metal.

Japanese Patent Application Post-Examination Publication Nos. 63-64518 (1988), 03-35387 (1991), etc. disclose cathodes which are coated with a nickel oxide or a cobalt oxide by flame spraying. These cathodes have the advantageous features that no impurities are eluted in the catholyte at the time of starting an electrolytic cell operation or during the cell operation, and that the performance characteristics of the cathode are not deteriorated even when it comes in contact with the air. However, the disclosed cathodes have the problem that the hydrogen overvoltage is higher than that of the cathode that is composite-plated with Raney nickel or Raney nickel and a hydrogen-occluding alloy.

Further, various types of low-hydrogen overvoltage cathode formed with an electrode active layer containing a platinum metal have been proposed. For example, Japanese Patent Application Post-Examination Publication Nos. 63-41994 (1988) and 61-45711 (1986) disclose low-hydrogen overvoltage cathodes which use a platinum metal in the form of a Raney metal type alloy and, hence, have an advantage in that the cathode activity is high even if the amount of platinum metal used is relatively small. However, these cathodes suffer from the problem that when they come in contact with the air, the cathodes may ignite, or the cathode activity may deteriorate. Japanese Patent Application Post-Examination Publication Nos. 61-36591 (1986) and 61-48582 (1986) disclose low-hydrogen overvoltage cathodes having a cathode active layer formed of a platinum metal by electroplating. However, since the cathode active layer is formed in a two-dimensional manner, the cathode activity is disadvantageously low.

It is an object of the present invention to provide a cathode having a low-hydrogen overvoltage, capable of stably sustaining the low-hydrogen overvoltage for a long period of time, having no possibility of its performance characteristics being deteriorated even when it is taken out of an electrolytic cell, and causing no elution of a substance contaminating the electrolyte at the time of starting an electrolytic cell operation or during the cell operation.

BRIEF DESCRIPTION OF THE DRAWINGS

The attached sole

SUMMARY OF THE INVENTION

Figure 1:
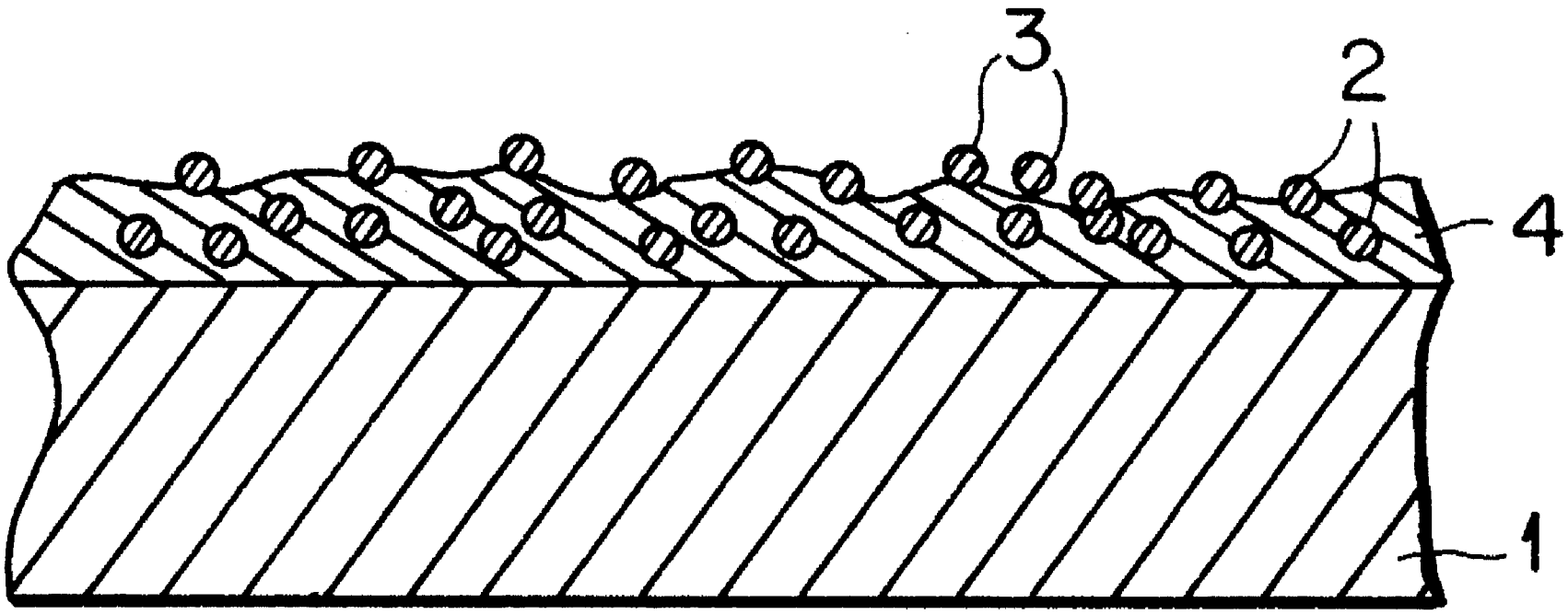
FIG. 1 is a sectional view showing the cathode of the present invention.

The present invention provides a low-hydrogen overvoltage cathode having an electrode active layer formed on a substrate, wherein the electrode active layer is a nickel layer having in its interior and on the surface thereof active carbon particles supporting at least one platinum metal selected from the group consisting of platinum, rhodium, iridium, and palladium.

In addition, the present invention provides a method of producing a low-hydrogen overvoltage cathode having an electrode active layer formed on a substrate, wherein the electrode active layer is formed by carrying out electroplating in a nickel plating bath in which are dispersed active carbon particles supporting at least one platinum metal selected from the group consisting of platinum, rhodium, iridium, and palladium.

DESCRIPTION OF THE PREFERRED EMBODIMENT

According to the present invention, a metallic electrode substrate is subjected to electroplating in a nickel plating bath in which are dispersed finely-divided active carbon particles supporting at least one platinum metal selected from the group consisting of platinum, rhodium, iridium, and palladium, thereby forming on the electrode substrate a nickel layer having platinum metal-supporting active carbon particles in its interior and on the surface thereof, and thus forming a cathode having a relatively large electrode reaction working surface by using a relatively small amount of platinum metal.

In the cathode of the present invention, a platinum metal has previously been supported in finely-divided active carbon particles, thereby enabling an electrode working surface having a substantially large area to be obtained with a relatively small amount of platinum metal.

In the present invention, at least one platinum metal selected from the group consisting of platinum, rhodium, iridium, and palladium is supported by active carbon.

To allow a platinum metal to be supported in active carbon in the present invention, it is possible to employ a method wherein purified active carbon, which has been washed with nitric acid and then subjected to rinsing and drying, is cast into a solution containing at least one platinum metal, and after being satisfactorily impregnated with the solution, the active carbon is alkalified with a solution, e.g., ammonia water, an alkali metal hydroxide solution, an alkali metal carbonate solution, etc., and then treated with a reducing agent, e.g., hydrazine, sodium borohydride, formalin, etc.

Examples of platinum metal compounds usable in the present invention include: hexachloroplatinic acid, hexabromoplatinic acid, and salts thereof; rhodium chloride, rhodium bromide, rhodium sulfate, rhodium nitrate, and hydrates or salts thereof; hexachloroiridic acid, hexabromoiridic acid, and salts thereof; and palladium chloride, palladium sulfate, and palladium nitrate. Platinum metals may be used alone or in the form of a mixture of two or more of them. Among platinum metals, platinum is particularly preferable because of its high hydrogen evolving activity. Palladium also exhibits a high hydrogen evolving activity, but it is readily deteriorated by a reverse current flowing when the electrolytic cell operation is suspended.

In the present invention, the amount of platinum metal supported in active carbon is preferably in the range of from not less than 0.01 $g/m^2$ to less than 10 $g/m^2$, more preferably from not less than 0.1 $g/m^2$ to less than 5 $g/m^2$. When the amount of platinum metal attached to the cathode is less than 0.01 $g/m^2$ the effect of the platinum metal cannot satisfactorily be exhibited, and a low hydrogen overvoltage cannot be attained. Even if the amount of platinum metal is increased to 10 $g/m^2$ or more, no particularly favorable effect can be obtained because the hydrogen overvoltage becomes constant at 40 mV to 50 mV.

In the present invention, the amount of active carbon attached to the cathode is preferably in the range of from not less than 10 $g/m^2$ to less than 200 $g/m^2$, more preferably from not less than 20 $g/m^2$ to less than 100 $g/m^2$, although it depends on the nickel plating conditions. When the amount of active carbon attached to the cathode is less than 10 $g/m^2$, the amount of platinum metal becomes excessively small, resulting in a high hydrogen overvoltage. When the amount of active carbon is not less than 200 $g/m^2$, the proportion of active carbon in the nickel deposit layer becomes excessively high; therefore, the mechanical strength lowers, causing the cathode to deteriorate early. A favorable result can be obtained by carrying out plating for 1 hour at a current density of 2 $A/dm^2$ for example.

Examples of nickel plating baths usable in the present invention are a Watts bath, a high-chloride bath, an all-chloride bath, a nickel sulfamate bath, etc. A platinum metal salt may be added to the nickel plating bath used in the present invention. However, if a sulfur-containing compound such as thiourea is added to the nickel plating bath, the sulfur component may be eluted in the electrolyte during electrolysis, or the overvoltage reducing effect attained by the platinum metal may be reduced. Therefore, addition of a sulfur-containing compound is unfavorable.

Preferable nickel plating conditions in the present invention are as follows: the current density is in the range of from 1 to 100 $A/dm^2$; pH is from 2 to 5; the temperature is from 30° to 90° C.; and the plating time is from 0.1 to 2 hours.

Examples of substrate materials usable in the present invention are stainless steel, nickel, soft steel, and nickel-plated soft steel.

With regard to the form of active carbon used in the present invention, pulverized form is preferable to particulate or granular form. Pulverized active carbon is preferable because it uniformly attaches to the substrate and hence makes it possible to produce a low-hydrogen overvoltage cathode having stable performance characteristics. Examples of active carbon usable in the present invention are those which are produced from coal, bone charcoal, coconut shell, wood, etc. It is preferable to use active carbon containing a minimal amount of heavy metal poisonous to the platinum metal used. The average particle diameter of the pulverized active carbon is preferably in the range of from not less than 10 μm to less than 100 μm. When the average particle diameter of the active carbon is less than 10 μm, the amount of active carbon attached to the substrate varies to a considerable extent. When the average particle diameter of the active carbon is not less than 100 μm, a distorted coating having a rough surface is produced. Thus, an average particle diameter less than 10 μm or not less than 100 μm is unfavorable.

Active carbon used in the present invention is preferably treated with an acid solution, e.g., nitric acid, before it is allowed to support a platinum metal, thereby eliminating impurities which may lower the activity of the platinum metal.

In the present invention, the concentration of finely-divided platinum metal-supporting active carbon dispersed in the plating bath is in the range of from not less than 1 g/l to less than 100 g/l. When the concentration of active carbon dispersed in the plating bath is less than 1 g/l, the active carbon content in the nickel deposit layer decreases, resulting in a high hydrogen overvoltage. When the concentration of active carbon is not less than 100 g/l, the active carbon content in the nickel deposit layer increases, resulting in a lowering of the mechanical strength. Consequently, the cathode deteriorates early.

The arrangement of the active cathode according to the present invention will be described below with reference to the accompanying drawing. The FIG. 1 is a sectional view of the active cathode according to the present invention. On a substrate 1, active carbon 2 supporting finely-divided platinum metal particles 3 is retained by a nickel layer 4. Since the active carbon 2 supporting finely-divided platinum metal particles is firmly attached to the substrate 1 by the nickel layer 4, there is no likelihood of the active carbon 2 falling off by the action of hydrogen gas evolved during electrolysis.

The cathode of the present invention has platinum metal-supporting active carbon particles disposed in the nickel layer and on the surface thereof. Therefore, the electrode surface area is increased to a considerable extent by the action of the active carbon, thus enabling the function of the platinum metal to be effectively utilized. Accordingly, it is possible to provide a cathode capable of stably performing electrolysis for a long period of time at a low hydrogen overvoltage. In addition, there is no elution of impurities from the cathode into the catholyte at the time of starting an electrolytic cell operation or during the cell operation. Further, there is no possibility of the cathode deteriorating its performance characteristics on contact with the air during dismantling of the electrolytic cell or under other circumstances.

The present invention will be described below more specifically by way of examples.

EXAMPLE 1

Pulverized active carbon (manufactured by Futamura Chemical; type W; dry product; the average particle diameter: 70 μm) was dipped in a 10% nitric acid solution and then heated for 3 hours by a hot bath. After filtration by suction, the active carbon was washed in pure water and then dried in a dryer, thereby preparing a sample for supporting a platinum metal. The active carbon was cast into each of solutions of platinum metallic compounds formed using hexachloroplatinic acid, rhodium(III) chloride hydrate, hexachloroiridic acid, and palladium chloride as raw materials, and allowed to stand for 4 hours at 50° C., thereby impregnating each platinum metallic compound solution into the pores. After being allowed to cool, the solution was alkalified with a sodium carbonate solution. Further, hydrazine was dropped into the alkalified solution. In this way, the active carbon was allowed to support finely-divided platinum metal particles. After being heated for 2 hours in a hot bath, the platinum metal-supporting active carbon was subjected to filtration by suction, followed by rinsing and drying in a desiccator.

Each platinum metal-supporting active carbon prepared as described above was added to a plating bath containing 84 g/l of nickel sulfate, 30 g/l of nickel chloride, 4.5 g/l of ammonium chloride, and 30 g/l of boric acid so that the slurry concentration was 5 g/l. In this plating bath, a pretreated expanded metal having a size of 100 mm×250 mm was electroplated for 1 hour at a temperature of 40° C. and a current density of 2 A/dm$^2$ thereby producing cathodes of Sample Nos. 1 to 11 as shown in Table 1 below.

Next, each cathode obtained as described above was placed, together with an insoluble metal anode (manufactured by Permelec Electrode (K.K.)), in an ion-exchange membrane electrolytic cell having a cation-exchange membrane (NAFION 90209, manufactured by Du Pont Co., Ltd.), and electrolysis was carried out under the following conditions: the current density was 4 kA/m$^2$; the electrolyte temperature was 90° C.; the sodium hydroxide concentration in the catholyte was 33% by weight; and the brine concentration in the anolyte was 3.6N. The hydrogen overvoltage value of each sample cathode is also shown in Table 1.

TABLE 1

| Sample No. | Platinum metal | Amount of platinum metal supported in active carbon (mg/g) | Amount of platinum metal (g/m$^2$ cathode) | Hydrogen overvoltage (V) |
|---|---|---|---|---|
| 1 | Platinum | 60 | 3.1 | 0.07 |
| 2 | Platinum | 30 | 1.5 | 0.08 |
| 3 | Rhodium | 40 | 2.2 | 0.07 |
| 4 | Rhodium | 20 | 1.0 | 0.08 |
| 5 | Iridium | 60 | 3.5 | 0.07 |
| 6 | Iridium | 30 | 1.7 | 0.08 |
| 7 | Palladium | 40 | 2.1 | 0.08 |
| 8 | Palladium | 20 | 1.0 | 0.08 |
| 9 | Platinum | 20 | 1.0 | 0.08 |
| | Rhodium | 20 | 1.0 | |
| 10 | Platinum | 20 | 1.1 | 0.08 |
| | Iridium | 20 | 1.1 | |
| 11 | Platinum | 20 | 1.0 | 0.07 |
| | Palladium | 20 | 1.0 | |

COMPARATIVE EXAMPLE 1

A cathode was produced in the same way as in Example 1 except that active carbon supporting no platinum metal was used, and electrolysis was carried out by using this cathode. The hydrogen overvoltage of the cathode was 0.25 V.

COMPARATIVE EXAMPLE 2

Cathodes were produced in the same way as in Example 1 except that active carbon supporting no platinum metal was used, and that various platinum metallic compounds were added to the nickel plating bath. Electrolysis was carried out in the same way as in Example 1 by using each of the cathodes thus obtained. Table 2 below shows the platinum metals used, the platinum metal concentrations in the plating bath, and the hydrogen overvoltages obtained.

TABLE 2

| Sample No. | Platinum metal | Amount of platinum metal (mg/l) | Hydrogen overvoltage (V) |
|---|---|---|---|
| 12 | Platinum | 30 | 0.22 |
| 13 | Rhodium | 30 | 0.20 |
| 14 | Iridium | 100 | 0.12 |

TABLE 2-continued

| Sample No. | Platinum metal | Amount of platinum metal (mg/l) | Hydrogen overvoltage (V) |
|---|---|---|---|
| 15 | Palladium | 30 | 0.15 |

As has been described above, the cathode of the present invention has on an electrode substrate a nickel deposit layer having platinum metal-supporting active carbon particles in its interior and on the surface thereof, which is formed by carrying out electroplating in a nickel plating bath in which are dispersed active carbon particles supporting at least one platinum metal. Accordingly, it is possible to effectively utilize the activity of the platinum metal and to provide a cathode capable of stably performing electrolysis for a long period of time at a low hydrogen overvoltage.

What we claim is:

1. A low-hydrogen overvoltage cathode comprising an electrode active layer formed on a substrate, wherein said electrode active layer is a nickel layer having in its interior and on a surface thereof active carbon particles supporting at least one platinum metal selected from the group consisting of platinum, rhodium, iridium, and palladium.

* * * * *